United States Patent [19]

Detzel

[11] Patent Number: 5,029,751

[45] Date of Patent: Jul. 9, 1991

[54] PACK MADE FROM A SINGLE-PIECE BOARD BLANK

[75] Inventor: Josef Detzel, Kempten, Fed. Rep. of Germany

[73] Assignee: Van den Bergh Foods Co., Division of Conopco, Inc., Lisle, Ill.

[21] Appl. No.: 546,154

[22] Filed: Jun. 28, 1990

[30] Foreign Application Priority Data

Jun. 29, 1989 [DE] Fed. Rep. of Germany ..... 3921339

[51] Int. Cl.[5] ..... B65D 5/42

[52] U.S. Cl. ..... 229/125.42; 229/8; 229/137

[58] Field of Search ..... 229/8, 137, 125.42; 206/620, 621.1, 621.2, 631.3

[56] References Cited

U.S. PATENT DOCUMENTS

| | | | |
|---|---|---|---|
| 1,157,462 | 10/1915 | Van Wormer | 206/621.2 |
| 2,936,940 | 5/1960 | Berghgracht | 229/8 |
| 4,327,833 | 5/1982 | Kuchenbecker | 229/137 |
| 4,343,402 | 8/1982 | Holmstrom | 206/621.2 |
| 4,546,884 | 10/1985 | Kuchenbecker | 206/620 |

FOREIGN PATENT DOCUMENTS

| | | | |
|---|---|---|---|
| 30387980 | 10/1984 | Fed. Rep. of Germany . | |
| 315243 | 9/1969 | Switzerland | 206/621.2 |
| 1033661 | 6/1966 | United Kingdom | 229/8 |

*Primary Examiner*—Gary E. Elkins
*Attorney, Agent, or Firm*—Ronald A. Koatz

[57] ABSTRACT

Pack made from a single-piece board blank, to the inside of which a sealable coating is applied. An edge strip, which extends approximately across half of the two side panels and an adjacent end panel of the pack and the transition of which from the free half of the side panel is at least approximately right-angled, is provided at the top free edge of the pack above a sealed seam.

1 Claim, 2 Drawing Sheets

PACK MADE FROM A SINGLE-PIECE BOARD BLANK

DESCRIPTION

The invention relates to a pack made from a single-piece blank produced from board or a similar material, which is coated with a sealable plastic layer on its inside facing the product, with a base section, two side panels and two end panels which are joined by folding lines and with folding lines to divide gusset sections off from the base section and the two end panels of the pack, the folding lines between the side panels and the end panels extending as an extension to the folding lines dividing up the base section, and with a sealed seam, in which the two side panels and the end panels folded in themselves rest on top of each other, extending across the top edge of the pack.

Such packs are very advantageous to use and are particularly suitable for packaging liquids, as they are still strong enough even when the volume contained is large.

The result is, however, that they are very difficult to open.

The purpose of the invention is to design a pack of the kind outlined above in such a way that it is easy to open even without the help of any tools.

In the solution to this problem proposed by the invention, an edge strip is provided at the top free edge of the sealed seam that extends approximately across half of the two side panels and an adjacent end panel and has an at least approximately right-angled transition from the free half of the side panel.

This makes it possible to take hold of this edge strip and tear the pack open.

It is also very advantageous if in accordance with the invention the transition from the free half of the side panel to the edge strip is provided with a notch.

This makes it even easier to tear the pack open.

In a further advantageous development of the invention the sealed seam at the top end of the pack is stepped and runs parallel to the outside edge.

This means that the sealed seam is also torn open when the pack is torn open.

This simultaneous tearing open of the sealed seam is guaranteed if in accordance with the invention the sealed seam in the edge strip extends above a theoretical extension line of the top edge of the free side panel.

It has also proved to be very advantageous if in accordance with the invention the folding lines between the side panels and the end panels are curved at their top end and meet, as a result of which the two end panels have a triangular top section.

This guarantees that the upper section of the pack really is flat and can also be opened easily.

One embodiment of the invention is illustrated in the drawings.

Figure 2:
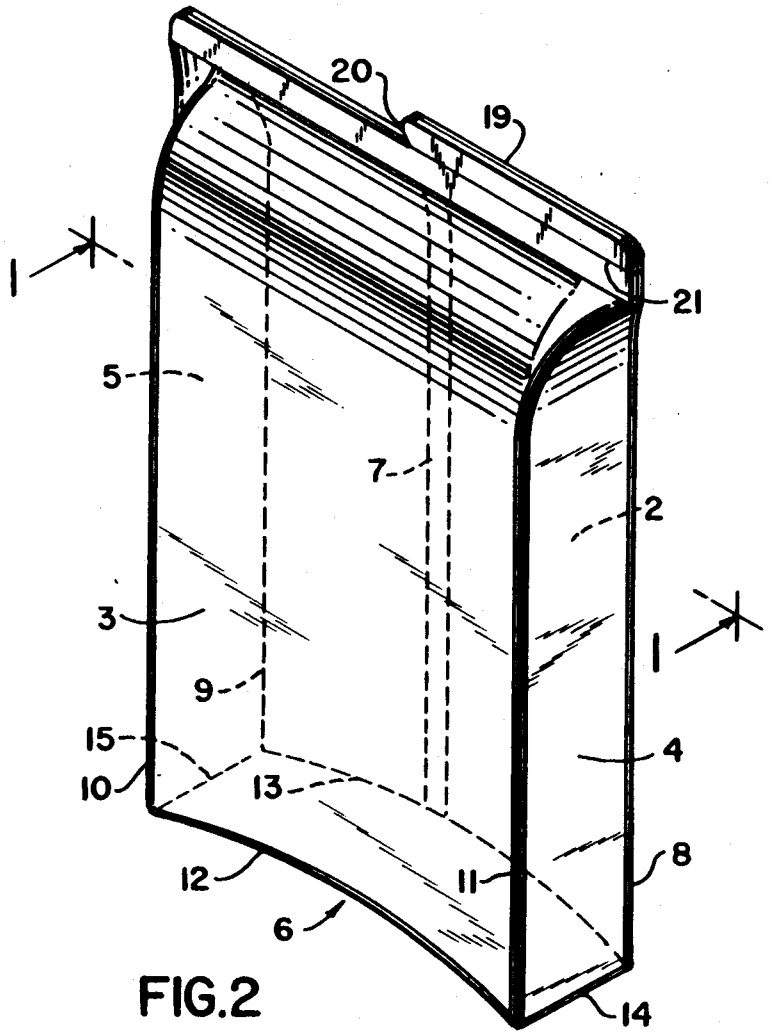
FIG. 2 shows the same pack.
Figure 1:
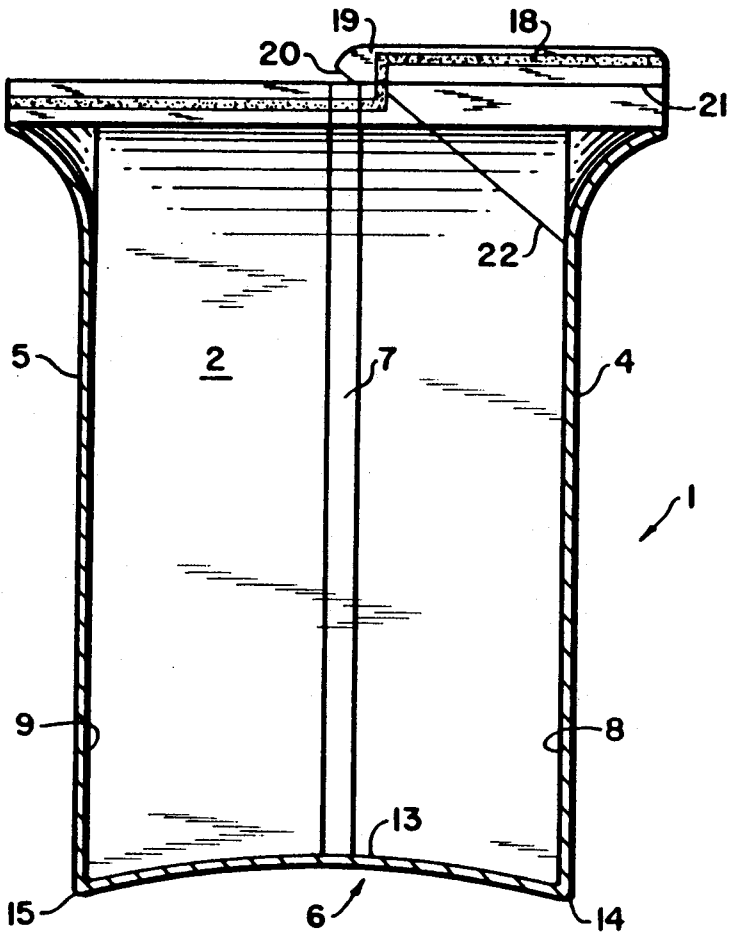
FIG. 1 is a side view of a pack.
Figure 3:
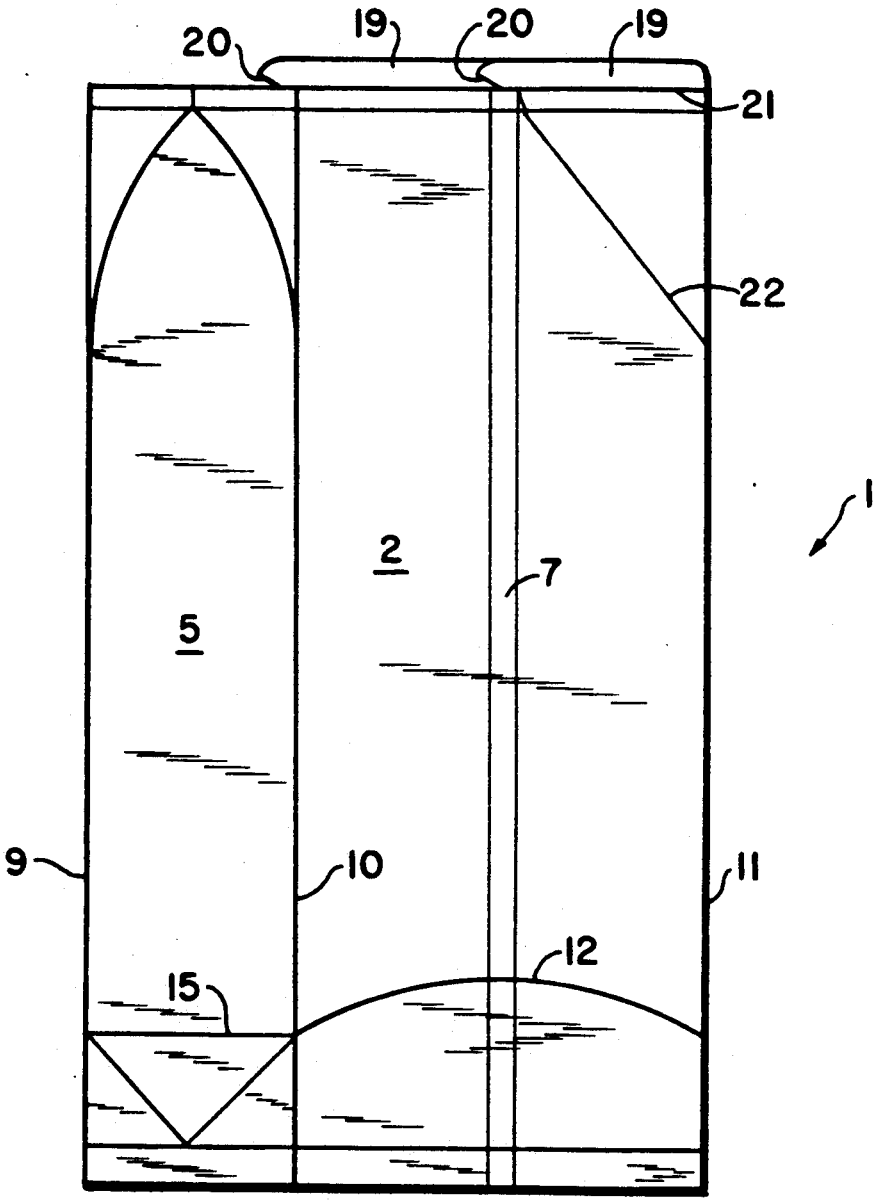
FIG. 3 shows a pre-glued and then fattened pack.

1 in FIGS. 1 and 2 is a pack erected from a single-piece board blank. This board blank is coated with a sealable plastic layer on both its inside and its outside. The pack has two side panels 2 and 3 and two narrower end panels 4 and 5 as well as a base section 6. The side panel 2 consisting of two sections is closed by a longitudinal sealed seam 7. This sealed seam 7 also extends across the base section 6, which also consists of two sections and thus forms a sleeve that is open at the top and the bottom and can be flattened again, as is shown in FIG. 3. The sleeve is flattened along two of four folding lines 8, 9, 10, 11 between the side panels 2, 3 and the end panels 4, 5. The base section 6 is divided off from the relevant side panel 2, 3 by a curved folding line 12/13, the ends of which are joined by a straight folding line 14, 15 that extends across the bottom end of the end panels 4, 5. The sections divided off by these folding lines 14, 15 are divided up into gussets by two further folding lines 16, 17. In order to erect the pack, the sleeve is first of all formed back into a shape with a rectangular cross section, which is then closed at its bottom end by a transverse sealed seam. This transverse sealed seam is then folded until it rests against the base section and the base is at the same time pressed inwards slightly. As a result of this, the gussets formed by the folding lines 14, 15, 16, 17 project roughly vertically from the base and are folded against the same in a further operation. The pack can now be filled via its top end. A transverse sealed seam 18 is then produced here as well, which extends as shown by the shaded area in the drawing.

This sealed seam 18 extends across half of each of the two side panels 2, 3, across the folded-together end panel 5 and across an edge strip 19 provided on the other half of the two side panels and the other end panel, and is Z-shaped. A notch 20 is provided at the beginning of the edge strip 19 at the transition between this edge strip and the free half of the side panel.

In order to open the pack, the edge strip 19 is torn open, starting at the notch 20 and extending roughly along a line 21. As a result, the sealed seam 18 is removed in the area of the edge strip and the pack is opened in this area. The purpose of an oblique folding line 22 is to form a pouring spout, which facilitates removal of the product considerably.

I claim:

1. A pack made from a single-piece blank produced from board wherein said pack comprises a base section, two side panels and two end panels joined by folding lines, wherein the folding lines between the two side panels and the two end panels are curved at their top end and meet and result in the two end panels having a triangular top section, wherein the folding lines between the side panels and the end panels extend as an extension of additional folding lines dividing up the base section, and wherein additional folding lines between the base section and the two end panels define gusset sections attached to bottom ends of the end panels;

said pack further comprising a sealed seam at a top end of the pack, which seam is stepped and runs parallel to an outside edge of the top end, said seam extending across half of the two side panels and an adjacent end panel, making an approximately right-angled transition at a half-way point of the side panels and further extending, above a theoretical extension line of a top edge of the side panel, across a second half of the two side panels and an adjacent end panel;

said pack further comprising an edge strip at the top edge of the portion of said sealed seam beginning at said half-way point and extending across the second half of the two side panels and adjacent end panel, wherein the approximately right-angled transition point at the half-way point where the edge strip begins is provided with a notch.

* * * * *